United States Patent [19]

Seiford, Sr.

[11] 3,955,525

[45] May 11, 1976

[54] WATERCRAFT DOCKING MECHANISM AND METHOD

[75] Inventor: Donald S. Seiford, Sr., Inver Grove Heights, Minn.

[73] Assignee: Twin City Shipyard, Inc., St. Paul, Minn.

[22] Filed: Mar. 13, 1973

[21] Appl. No.: 340,666

[52] U.S. Cl. ..... 114/235 R; 104/163; 104/168; 115/6

[51] Int. Cl.[2] ..... B63B 21/56

[58] Field of Search ..... 114/44, 230, 235 R, 114/236, 237, 219, .5 BD, 220; 115/6, 8, 9; 198/167, 127; 104/162, 163, 168; 214/14

[56] References Cited

UNITED STATES PATENTS

| | | | |
|---|---|---|---|
| 3,060,885 | 10/1962 | Nolf | 114/230 |
| 3,254,491 | 6/1966 | Levinton | 114/219 |
| 3,311,082 | 3/1967 | O'Neill | 115/8 |
| 3,362,546 | 1/1968 | Sale | 214/14 |
| 3,400,807 | 9/1968 | Nickla et al. | 198/167 |
| 3,606,855 | 9/1971 | Saxonmeyer | 114/230 |
| 3,613,599 | 10/1971 | Seidman | 104/168 |
| 3,670,658 | 6/1972 | Stelling | 104/168 |

FOREIGN PATENTS OR APPLICATIONS

| | | | |
|---|---|---|---|
| 1,455,008 | 10/1969 | Germany | 104/168 |
| 166,888 | 1/1965 | U.S.S.R. | 114/230 |
| 1,268,172 | 5/1968 | Germany | 104/168 |
| 177,294 | 1/1966 | U.S.S.R. | 114/44 |
| 694,503 | 7/1940 | Germany | 114/44 |
| 532,193 | 1/1941 | United Kingdom | 114/230 |

*Primary Examiner*—Trygve M. Blix
*Assistant Examiner*—Edward R. Kazenske
*Attorney, Agent, or Firm*—Edwin E. Greigg

[57] ABSTRACT

A docking mechanism for watercraft such as barges and the like which is readily secured to a mooring pile and is floatable, the mechanism including a driving apparatus which is engageable with and drives the watercraft and apparatus for effecting the driving engagement. A method of controlling the direction of travel of a watercraft such as barges and the like between particular points from preferably an on-shore control station according to which the driving apparatus of the docking mechanism mentioned above is controlled in its driving relationship to the watercraft.

9 Claims, 7 Drawing Figures

ON-SHORE CONTROL & POWER SUPPLY
TO ON-SHORE CONTROL
WATER LINE

WATERCRAFT DOCKING MECHANISM AND METHOD

BACKGROUND OF THE INVENTION

The present invention relates to controlling the direction of travel of watercraft, and more particularly to a docking mechanism for watercraft such as barges and other water-borne vessels which require their direction of travel to be controlled to particular points, for example, to a proper position for loading or unloading cargo.

The problem of controlling the direction of travel of watercraft during a docking operation, for example, is one of long standing. If, for example, the proper degree of control is not maintained the chances of damage to both the watercraft and the shore installation as well as the threat to personnel safety, are enhanced. It is for at least this reason that docking operations are quite time consuming, and most often require guiding vessels for practically the complete docking operation.

It would be desirable, therefore, to have a way of controlling the direction of travel of watercraft during a docking operation so that the accompanying adverse aspects mentioned above are substantially eliminated.

OBJECTS AND SUMMARY OF THE INVENTION

It is, therefore, a general object of the controlling invention to provide means for contolling the direction of travel of watercraft during a docking operation or the like which substantially eliminates the adverse aspects mentioned above.

It is a more specific object of the present invention to provide a system and an associated mechanism which is capable of driving a watercraft in a given direction and in a controlled manner.

It is another object of the present invention to provide a mechanism that is economical to manufacture, easily transportable, efficient in operation and readily adaptable for assembly with a mooring pile.

It is still another object of the present invention to provide a method of controlling the direction of travel of a watercraft from preferably an on-shore control station.

These and other objects are accomplished according to the present invention by a mechanism comprising a unit assembly capable of being secured to a mooring pile in such a manner that it can rise and fall with the tide and is always in proper retracted position to accommodate a watercraft in operative association therewith whereupon it may be advanced into an operative position for either driving the watercraft toward or away from a loading area; and by a method which preferably utilizes an on-shore control station for controlling the direction of travel of a watercraft between particular points which includes controlling the driving aspect of the aforementioned mechanism.

DESCRIPTION OF THE PREFERRED EMBODIMENTS

Figures 1, 1A, 2, 5:
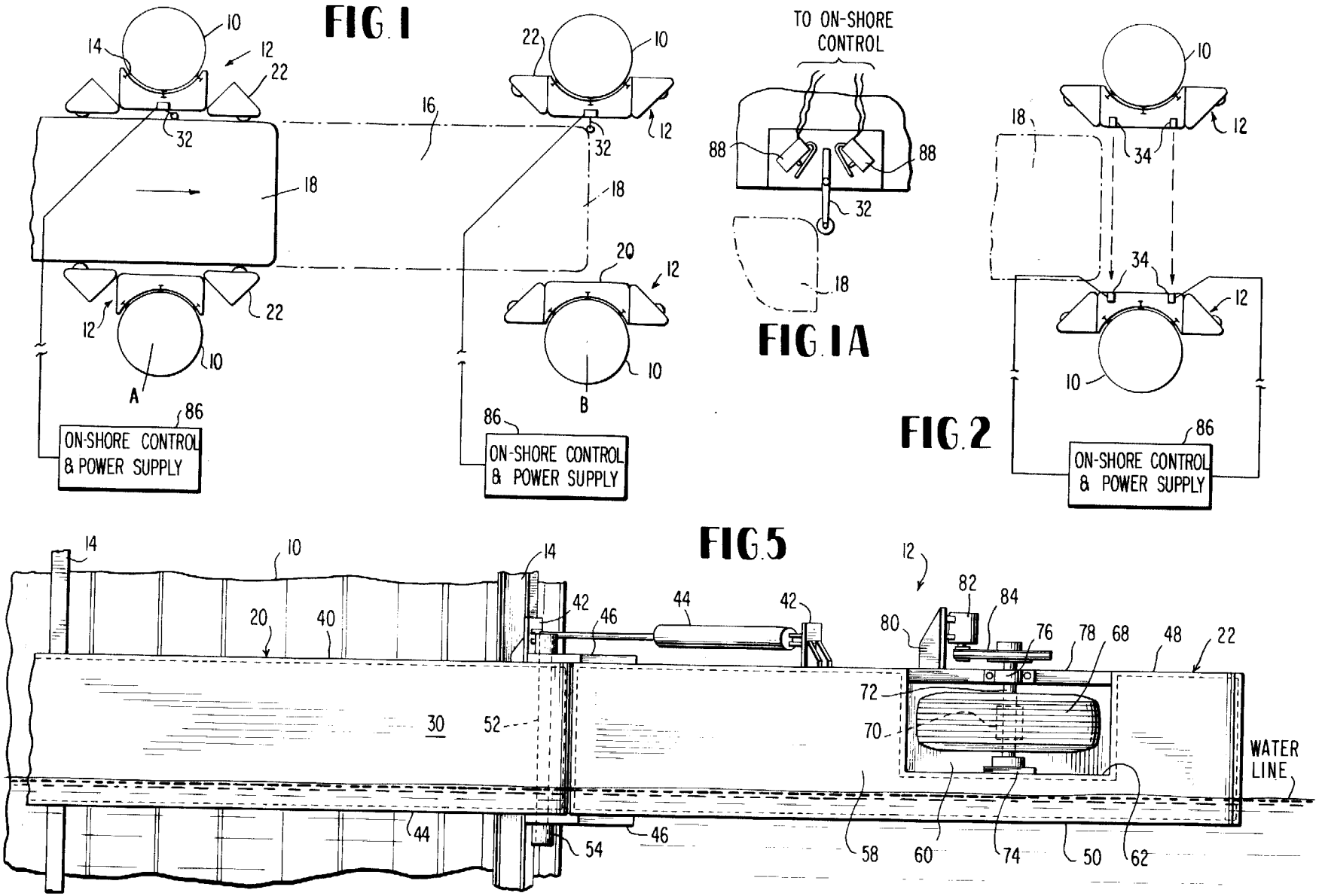
FIG. 1 is a schematic plan view illustrating adjacent assembled units each including a mechanism according to the present invention in their retracted position and in their extended and driving position in driving engagement with a watercraft, each unit being illustrated to include a sensing mechanism.
FIG. 1A is a partial schematic plan view of FIG. 1 to an enlarged scale illustrating further details of the sensing mechanism for sensing the presence and departure of a watercraft for a given assembled unit.
FIG. 2 is a schematic plan view similar to FIG. 1 illustrating an alternative embodiment of the sensing mechanism.
FIG. 5 is a view in elevation of the symmetrical half of the assembled unit illustrated in FIG. 4.

Referring now more specifically to FIG. 1, there are shown two adjacent stations, A and B, of two parallel rows of aligned mooring piles 10, it being understood, however, that the system contemplated may have any desired number of stations. Each pile 10 is securely station in any conventional manner so that it projects above the surface of the water for at least a sufficient distance to accommodate a docking mechanism 12. The exterior walls of the piles 10 have vertically extending rails 14 secured thereto. These rails 14 serve the purpose of slidably supporting the docking mechanisms 12 in the vertical direction. Three such rails, in the form of I-beams, are provided for each pile 10, although it should be understood that any number and configuration of rails may be employed as desired. The docking machanisms 12 are preferably buoyant so that when they are secured to their respective piles 10 on the rails 14, they float on the surface of the water.

The rows of assembled units, that is, the rows of piles 10, each pile securing a docking mechanism 12, define a passage 16 which is traversed by a watercraft 18, such as a barge or the like, preferably to and from a docked position. It is only necessary for the watercraft 18 to enter the passage 16 and reach a first station, as is shown for example in FIGS. 1 and 2 where the watercraft 18 has reached station A, either under its own power or with assistance. The docking mechanism 12 of each assembled unit is then actuated to drive the watercraft 18 along the passage 16. Note that adjacent stations are sufficiently spaced apart so that a continuous movement of the watercraft is realized.

Figure 4:
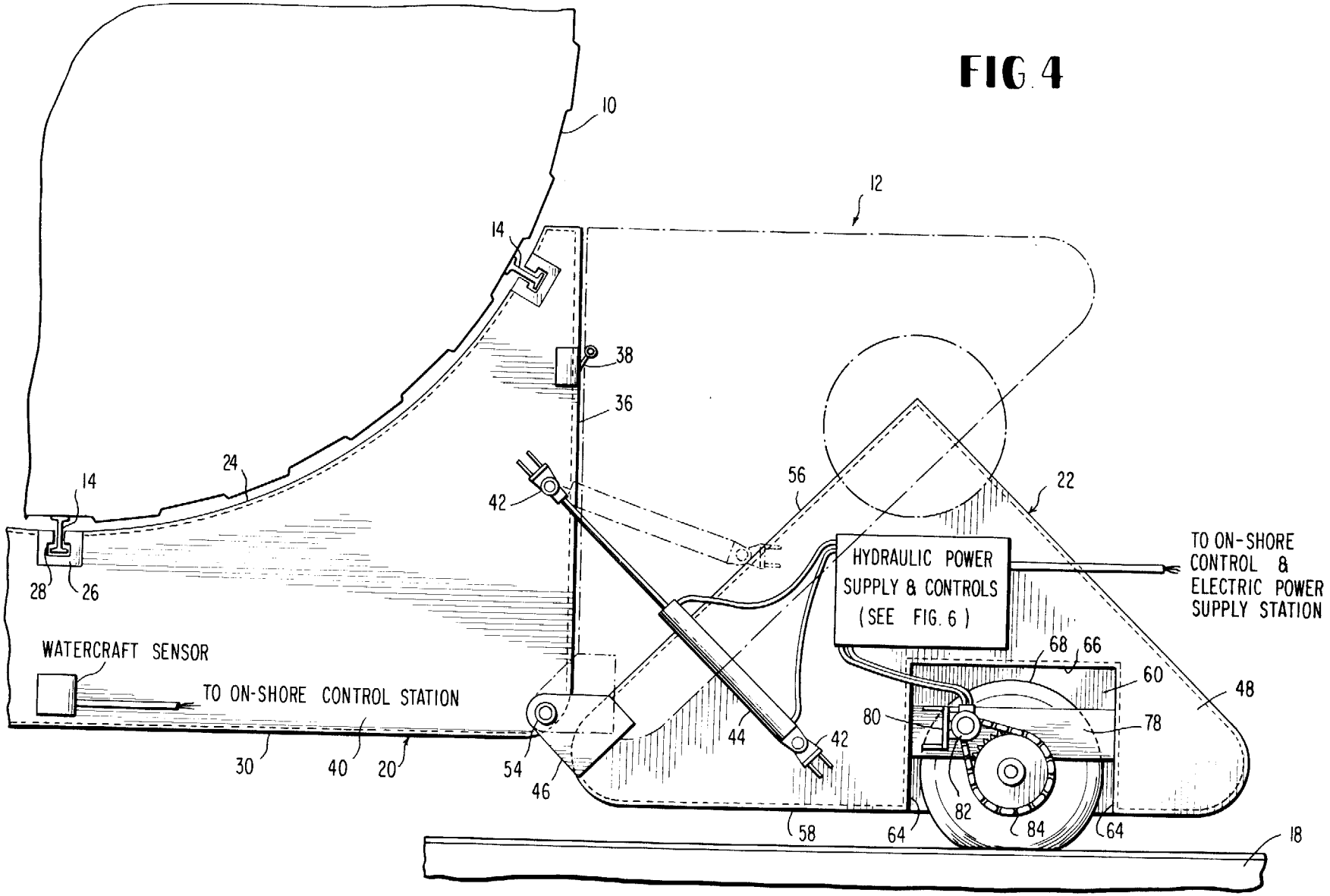
FIG. 4 is a top plan view of a symmetrical half of an assembled unit according to the present invention illustrating the pontoon structure in both its retracted and extended positions.

Referring now to FIGS. 4 and 5, further and more specific details of the docking mechanisms 12 can be seen. Each of the docking mechanisms 12 comprises a support structure 20, which is secured to a mooring pile 10, and a separate pontoon structure 22 hinged on either side of the support structure 20 for pivotal movement relative thereto between a retracted and extended position.

Preferably the support structure 20 and the pontoons 22 are buoyant shell-like structures of unitary construction which when assembled and secured to a mooring pile 10 are free to move in a vertical direction. It should be understood however that these structures may be differently fabricated and fixed to the mooring pile 10 in other vertical positions and still accomplish the driving function intended.

One wall 24 of the support structure 20 is curved to essentially conform to the outer curvature of its respective mooring pile 10. Inserted at spaced locations along the surface 24 are inserts 26 which extend sealingly into the support structure 20. The inserts 26 may be single units which extend the full height of the support structure 20, or they may be aligned units confined in each case to the top and bottom region of the support structure 20, or they may assume any other positional relationship to the support structure 20 desired, it being only necessary that they secure the support structure 20 to the mooring pile 10 so that the docking mechanism 12 is preferably vertically displaceable. Each of the inserts 26 is sealed to the support structure 20 in a conventional manner, and define preferably a T-shaped cutout 28 which accommodates to the free end of the rail 14.

Figure 3:
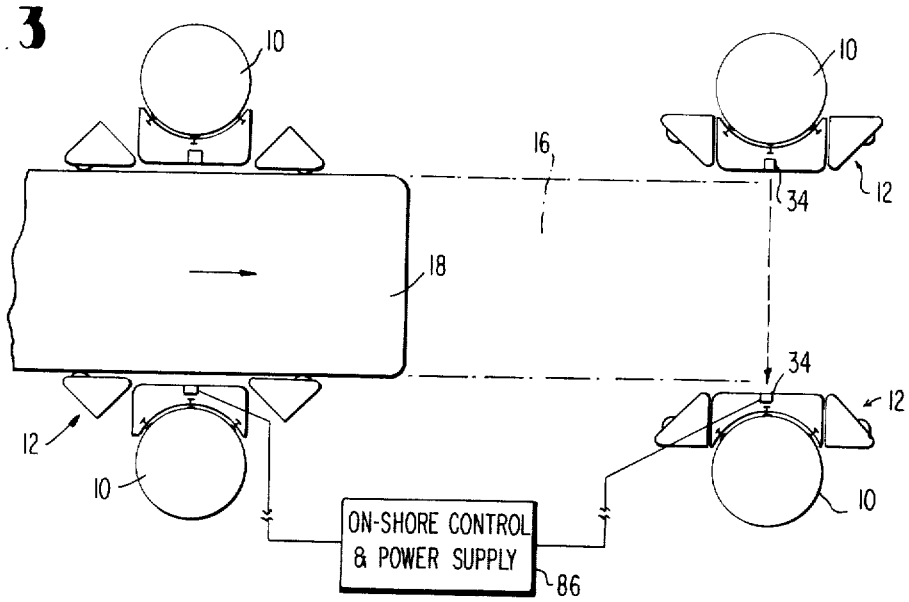
FIG. 3 is a schematic plan view illustrating a part of FIG. 2 and according to which each of the pontoon structures according to the present invention is provided with an alternate embodiment of the sensing mechanism.

The front outwardly facing wall 30 of the support structure 20 supports a watercraft sensor such as the lever switch 32 and the contacts 88 (FIG. 1A), or the photocells 34 (FIG. 2 and 3). The purpose of the sensors will be described hereinafter.

Each of the side walls 36 of the support structure 20 has a limit switch 38 mounted thereto. The limit switches 38 are actuated by a respective one of the pontoon structures 22, and specifically by side walls 56 thereof. The purpose of the limit switches 38 will become clear from the description set forth hereinafter.

Mounted on the top wall 40 of the support structure 20, near the side walls 36, are mounting brackets 42 to which one end of a hydraulic actuator 44 is pivotally mounted. Both the top wall 40 and the bottom wall 44 of the support structure 20 receives the free ends of lug plates 46 at their outer adjacent corners. The lug plates 46 extend from and are fastened, in any conventional manner, to the top and bottom walls 48 and 50, respectively, of the pontoon structures 22. At the respective corners of the support structure 20, a bolt 52 is accommodated. The bolts 52 project outwardly from the walls 40 and 44, respectively. The ends of the bolts 52 may, for example, be threaded for receiving a cap member 54 into threaded engagement therewith. The lug plates 46 and consequently the pontoon structures 22 are releasably fastened and pivotally movable with respect to the support structure 20.

Each pontoon structure 22 has also mounted on its top wall 48 a mounting bracket 42, which is similar to the bracket mounted on the top wall 40 of support structure 20. This mounting bracket 42 mounts the other end of the actuator 44. The actuator 44 is preferably a double-acting hydraulic actuator which effects the pivotal movement of the pontoon 22 relative to the support structure 20 between its retracted and extended positions. Extending down from the top wall 48 and inwardly from the front wall 58 of the pontoon structure 22 is a sealed recess defining a wheel well 60 including a bottom wall 62, side walls 64 and an end wall 66. Mounted for rotation within the wheel well 60 is a preferably pneumatic tire 68.

The tire 68 is mounted on a hub 70 which in turn is mounted to an axle 72 which is suitably secured within bearing blocks 74 and 76. The hub 70 is mounted to the axle 72 so as to be relatively fixed along the longitudinal axis of the axle, as can be seen in FIG. 5. The bearing block 74 is mounted to the bottom wall 62 of the wheel well 60, while the bearing block 76 is mounted to a plate-like element 78, which extends between and is secured in any conventional manner to the side walls 64 at the top of the wheel well 60.

Mounted to the plate-like element 78 is a motor mount 80 to which a preferably hydraulic motor 82 is attached. The motor 82 drives the tire 68 through a chain and sprocket drive 84 situated between the axle 72 and the motor 82.

Figure 6:
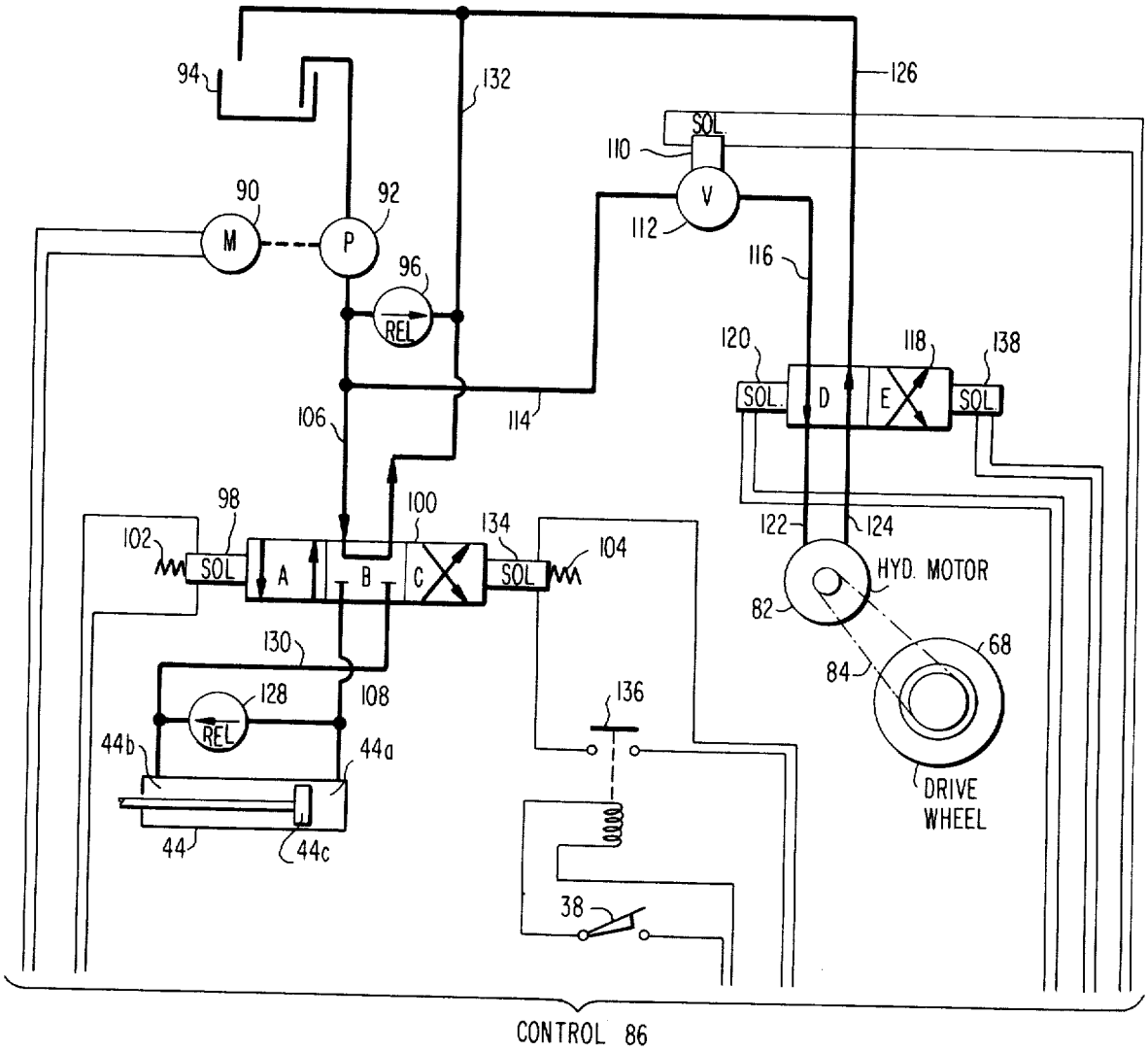
FIG. 6 is a circuit diagram associated with each pontoon structure actuator illustrating the hydraulic circuit and parts of its associated electrical circuit for controlling the movement of the structure.

Both the actuator 44 and the motor 82 form elements of a hydraulic circuit, the details of which are shown in FIG. 6.

Before proceeding to a detailed consideration of the hydraulic circuit, however, it would be beneficial to first broadly discuss the method associated with controlling the direction of travel of the watercraft 18 along the passage 16. For this purpose it should be noted that the method contemplates the provision of an on-shore control, which for convenience has been indicated by the block identified by the reference number 86. The control 86 is located to provide visual inspection of the overall installation so that manual supervision and control of the progress being made by the watercraft can be effected. The details of the control 86 are not per se important since they do not form a part of the inventive concept. For example, the control 86 may include a console panel which an operator uses in a manner which will become apparent to control movement of the watercraft 18.

Referring again to FIG. 1, the watercraft 18 is shown moving along the passage 16 with the pontoon structures 22 of the docking mechanisms 12 at station A in driving engagement with the sides of the watercraft. The first activity initiated as a result of the watercraft 18 approaching station A is the engagement and actuation of the lever switches 32 situated at the sensor stations on the docking mechanisms 12 at station A. Actuation of the lever switches 32 in turn closes the contacts 88 (FIG. 1A) which renders an indication on the console of the control 86 to the operator that the watercraft 18 is now in position to be driven by a particular set of adjacent docking mechanisms 12. The operator then causes the related pontoon structures 22 to engage the sides of the watercraft 18 to continue driving it along the passage 16. When the watercraft 18 passes the lever switches 32, they are returned to their neutral position, as shown in FIG. 1A, by any suitable means such as a spring (not shown). Consequently the contacts 88 are opened resulting in the console indication being altered, thereby signalling the operator that the docking mechanisms associated with those contacts can be retracted to their inoperative position.

As an alternative to the lever switches 32 and the contacts 88, a photocell arrangement 44 (FIG. 3), or a pair of photocell arrangements 34 (FIG. 2) may be utilized. The single photocell arrangement shown in FIG. 2 would control all the pontoon structures associated with the two docking mechanisms, while the dual photocell arrangement shown in FIG. 3 would afford individual control for corresponding ones of the pontoon structures associated with the two docking mechanisms. In any case, the operation would be similar to that discussed above with reference to FIGS. 1 and 1A.

It should be understood that the method is applicable whether movement of the watercraft 18 is from left-to-right or from right-to-left as viewed in FIGS. 1 and 2.

The operation of the hydraulic circuit shown in FIG. 6, which is provided for each pair of hydraulic actuators 44 and their corresponding hydraulic motors 82, will now be described. As indicated in FIG. 6 all the electrically controlled elements lead to the on-shore control 86. As stated above, with reference to FIGS. 1 and 1A, when the watercraft 18 passes the watercraft sensor of a given docking mechanism 12, the lever switch 32 is actuated which in turn closes the contacts 88 so that the operator will know that it is time to engage those pontoon structures, associated with the contacts 88, with the sides of the watercraft 18. To accomplish this result, the operator energizes the hydraulic circuit of each of the pontoon structures involved. For each circuit the operator energizes a motor 90 which in turn actuates a pump 92. Actuation of the pump 92 draws hydraulic fluid from the reservoir 94 to thereby prime the system. Next the operator takes the necessary action to energize the solenoid 98 of a routing valve 100, which up to this time has been in its neutral position B. Energizing the solenoid 98 against the action of springs 102 and 104 shifts the routing valve from its neutral position B to its first active position A. When so positioned, the pump 92 feeds hydraulic fluid through the line 106, the valve 100 and the line 108 into the chamber 44*a* of the hydraulic actuator 44. The hydraulic fluid in the chamber 44*a* acts against the piston 44*c* to extend the actuator 44 and thereby move its associated pontoon structure 22 from its retracted position to its driving position. The operator then energizes the solenoid 120 to place a routing valve 118 into its position D, if it is not already there as a result of a previous actuation, and energizes the solenoid 110 to open the valve 112 and permit the pump 92 to deliver hydraulic fluid through the line 114, the valve 112, the line 116, the routing valve 118 and the line 122 to the hydraulic motor 82. The return from the hydraulic motor 82 is through the line 124, the valve 118 and the line 126 to the reservoir 94. The hydraulic motor 82 rotates the drive wheel 68 through the sprocket assembly 84, as has been pointed out above. The valve 112 is provided to control the rate of rotation of the drive wheel 68 and consequently the driving force imparted by the drive wheel 68 to the watercraft 18. Valves for this purpose are known, and therefore, need not be discussed in detail.

When the watercraft 18 passes the watercraft sensors at station A, the switches 32 and the contacts 88 are opened. The operator then knows that the pontoons 22 at station A can be retracted. To accomplish this he deenergizes the solenoid 98, which under the influence of the springs 102 and 104 is shifted back into its neutral position B, and energizes the solenoid 134 to shift the valve 100 to its second active position C. Energization of the solenoid 134 is possible since the contact 136 was closed by the closing of the limit switch 38 when the pontoon structure 22 was initially displaced from its retracted position. As a result of shifting the valve 100 to its second active position C, hydraulic fluid is now delivered from the line 106, through the valve 100 and the line 130 to the chamber 44b of the hydraulic actuator 44. Consequently, the piston 44c is moved to retract the actuator 44 and thereby the pontoon 22. In retracting the pontoon 22, the limit switch 38 is engaged by the side wall 56 and consequently opened, thereby opening the contact 136. This results in an indication to the operator that the retracted position has been achieved so that the motor 90 can be deenergized and the drive force removed from the drive wheel 68.

To ensure that the pontoon 22 is controlled while being retracted, pressure relief valve 128 is provided between the lines 108 and 130. A pressure relief valve 96 is provided between the lines 106 and 132 for priming purposes and to control the return to the reservoir 94.

Note, as stated above, that in order to provide a continuous movement of the watercraft 18, the operator would preferably wait until he receives an indication from station B before deenergizing at station A. It should also be noted that if the watercraft 18 were proceeding in the opposite direction, the operation of the circuit would be the same with the exception that the valve 118 would be in the position E, having been placed in that position by the energization of the solenoid 138. This will allow the hydraulic motor 82 to drive the drive wheel 68 in the opposite direction. Also, it should be once again emphasized that the circuit would operate in a similar manner with the photocells illustrated in FIGS. 2 and 3, since the photocells, like the lever switches, simply provide the operator with an indication of when to extend and retract the pontoon structures.

It can be seen from the foregoing description of a preferred embodiment of the present invention that a novel docking mechanism and method for controlling the direction of travel of a watercraft between particular points utilizing an on-shore control station is now available. As a result, a safe and an economic way of, for example, docking watercraft such as barges is provided.

Having described the invention in detail and set forth its advantages, those familiar with this disclosure and the watercraft docking art may envision additions, deletions, substitutions, or other modifications which would fall within the purview of the invention as set forth in the appended claims.

I claim:

1. A docking mechanism for use in controlling the direction of travel of water-borne vessels, comprising:

a. a unitary support structure including means for mounting said support structure to a mooring pile;

b. unitary drive supporting means having drive means mounted thereto;

c. means mounting said drive supporting means directly to said support structure so that said drive supporting means can be pivotably moved as a unit relative to said support structure and in a plane substantially parallel to the water line defined by the top surface of the water; and d. means connected to at least said drive supporting means for pivotably moving said drive supporting means as a unit relative to said support structure and in said plane, said movement including advancing said drive supporting means toward a vessel for engagement of said drive means with the side of the vessel for driving the vessel and controlling its direction of travel, and retracting said drive supporting means from the vessel, as desired.

2. A docking mechanism as defined in claim 1, further comprising sensing means mounted to said docking mechanism for indicating the position of the vessel relative to said docking mechanism so that said drive supporting means may be advanced or retracted accordingly.

3. A docking mechanism as defined in claim 1, wherein both said support structure and said drive supporting means of said docking mechanism are constructed as buoyant shell-like structures, and wherein said support structure is adjustably mounted to the mooring pile.

4. A docking mechanism as defined in claim 1, wherein said means for advancing and retracting is mounted to said support structure and said drive supporting means and is fluid operated.

5. A docking mechanism as defined in claim 2, wherein said sensing means includes a pivotally mounted lever switch.

6. A docking mechanism as defined in claim 1, wherein said drive supporting means comprises a pontoon structure on either side of said support structure.

7. A docking mechanism as defined in claim 6, wherein each said pontoon structure includes a tire and means for rotating said tire as its drive means.

8. A docking mechanism as defined in claim 1, further comprising sensing means mounted to said docking mechanism for indicating the position of the vessel relative to said docking mechanism so that said drive support means may be advanced or retracted accordingly, wherein said means for advancing and retracting is mounted to said support structure and said drive supporting means, and wherein said drive means includes a vessel engaging rotationally mounted element and means for rotating said element when said element is in engagement with the vessel.

9. A system for controlling the direction of travel of water-borne vessels to and from a dock installation comprising a plurality of stations defining a path of travel with respect to the dock installation, each said station including a pair of parallel spaced mooring piles each having a docking mechanism mounted thereto, and an on-shore control installation having means connected to each docking mechanism, each said docking mechanism including:

a. a unitary support structure including means for mounting said support structure to its mooring pile;

b. unitary drive supporting means having drive means mounted thereto;

c. means mounting said drive supporting means directly to said support structure so that said drive supporting means can be pivotably moved as a unit relative to said support structure and in a plane substantially parallel to the water line defined by the top surface of the water; and d. means connected to at least said drive supporting means for pivotably moving said drive supporting means as a unit relative to said support structure and in said plane, said movement including advancing said drive supporting means toward a vessel for engagement of said drive means with the side of the vessel for driving the vessel and controlling its direction of travel, and retracting said drive supporting means from the vessel, as described, wherein the actuation of said means for pivotably moving said drive supporting means and said drive means is controlled by said on-shore control installation.

* * * * *